US008899434B2

(12) United States Patent
Falkman

(10) Patent No.: US 8,899,434 B2
(45) Date of Patent: Dec. 2, 2014

(54) THREE-DIMENSIONALLY HINGED CLAMSHELL PACKAGING SYSTEM HAVING A STANDING FEATURE

(75) Inventor: Ryan Christopher Falkman, Hanover Park, IL (US)

(73) Assignee: Transparent Container Co., Inc., Addison, IL (US)

( * ) Notice: Subject to any disclaimer, the term of this patent is extended or adjusted under 35 U.S.C. 154(b) by 953 days.

(21) Appl. No.: 12/953,595

(22) Filed: Nov. 24, 2010

(65) Prior Publication Data

US 2012/0125924 A1 May 24, 2012

(51) Int. Cl.
*B65D 43/16* (2006.01)

(52) U.S. Cl.
CPC ..... *B65D 43/161* (2013.01)
USPC ..... 220/4.22; 220/4.24; 220/810; 206/470; 206/471

(58) Field of Classification Search
CPC ..... B65D 43/161
USPC ..... 220/4.22, 4.24, 4.21, 4.23, 810, 712, 220/265; 206/461, 467, 470, 471; 215/201, 215/901, 250, 253, 254
See application file for complete search history.

(56) References Cited

U.S. PATENT DOCUMENTS

| | | | | |
|---|---|---|---|---|
| 1,596,349 | A * | 8/1926 | Guenther | 190/119 |
| 3,776,375 | A * | 12/1973 | Rohdin | 206/459.5 |
| 5,129,516 | A * | 7/1992 | Theros | 206/463 |
| 5,447,232 | A | 9/1995 | Chow | |
| 5,794,308 | A * | 8/1998 | Rentsch et al. | 16/225 |
| 6,364,114 | B1 | 4/2002 | Glassman | |
| D471,099 | S * | 3/2003 | Yang | D9/415 |
| 7,753,205 | B2 | 7/2010 | Shibata et al. | |
| 2005/0067318 | A1 * | 3/2005 | Cesario | 206/524.6 |
| 2007/0187274 | A1 | 8/2007 | Dalea et al. | |

* cited by examiner

*Primary Examiner* — Robert J Hicks
*Assistant Examiner* — Kareen Rush
(74) *Attorney, Agent, or Firm* — Greenberg Traurig, LLP

(57) ABSTRACT

A clamshell packaging system having a first side portion, a second side portion, and a base portion is provided with a three-dimensional hinge structure and a standing feature. The first side portion is attached to the base portion via a first hinge joint and the second side portion is attached to the base portion via a second hinge joint wherein the second side portion is closeable upon the first side portion to provide an enclosed clamshell. The base portion further includes a third hinge joint and a fourth hinge joint each of which extends between the first hinge joint and the second hinge joint in a direction that is generally transverse to at least a portion of each of the first hinge joint and the second hinge joint. The base portion additionally has at least one flat portion disposed between the third hinge joint and the fourth hinge joint upon which the clamshell packaging system is standable.

16 Claims, 4 Drawing Sheets

THREE-DIMENSIONALLY HINGED CLAMSHELL PACKAGING SYSTEM HAVING A STANDING FEATURE

BACKGROUND

The present disclosure generally relates to packages for containing and displaying consumer products and, more specifically, to a three-dimensionally hinged, clamshell packaging system that has a standing feature.

Clamshell packaging is a popular type of packaging used for various consumer products. Retail stores often utilize clamshell packaging because they provide a degree of theft deterrence while also allowing customers to clearly view the product. At the retail level, storage and display conditions vary widely. For example, many retail outlets display products contained in clamshell packaging on a hanging hook or rack. As a result, many clamshell packages incorporate an opening to accommodate such a hook or rack.

However, hooks and racks are not always available, and often times they are not the preferred method of storing or displaying a product. Often, retail outlets would prefer to display certain products on a flat surface such as a shelf or table display. However, known clamshell packaging designs are not designed to stand in an upright position. Many modern clamshell designs are not erectable at all. Even clamshell packaging designs that are erectable are often not balanced correctly, tilting either forward or backwards creating instability.

Thus, a need exists for a clamshell packaging system that can effectively hold and display a consumer product in a standing position. Such a packaging system would incorporate the traditional advantages of clamshell packaging, namely theft-deterrence and product visibility, while also providing a wide range of display options.

SUMMARY

A novel clamshell packaging system having a three-dimensional hinge structure and a standing feature is hereinafter described. In one preferred embodiment, the clamshell packaging system has a first side portion, a second side portion, and a base portion. The first side portion is attached to the base portion via a first hinge joint and the second side portion is attached to the base portion via a second hinge joint wherein the second side portion is closeable upon the first side portion to provide an enclosed clamshell. The base portion further includes a third hinge joint and a fourth hinge joint each of which extends between the first hinge joint and the second hinge joint in a direction that is generally transverse to at least a portion of each of the first hinge joint and the second hinge joint. The base portion additionally has at least one flat portion disposed between the third hinge joint and the fourth hinge joint upon which the clamshell packaging system is standable.

While the foregoing gives a general overview of the subject packaging design, various objects, advantages and features of the subject packaging design will be readily apparent to those of ordinary skill in the art upon review of the following detailed description of the preferred embodiments, taken in conjunction with the accompanying drawings.

DETAILED DESCRIPTION

Figure 1:
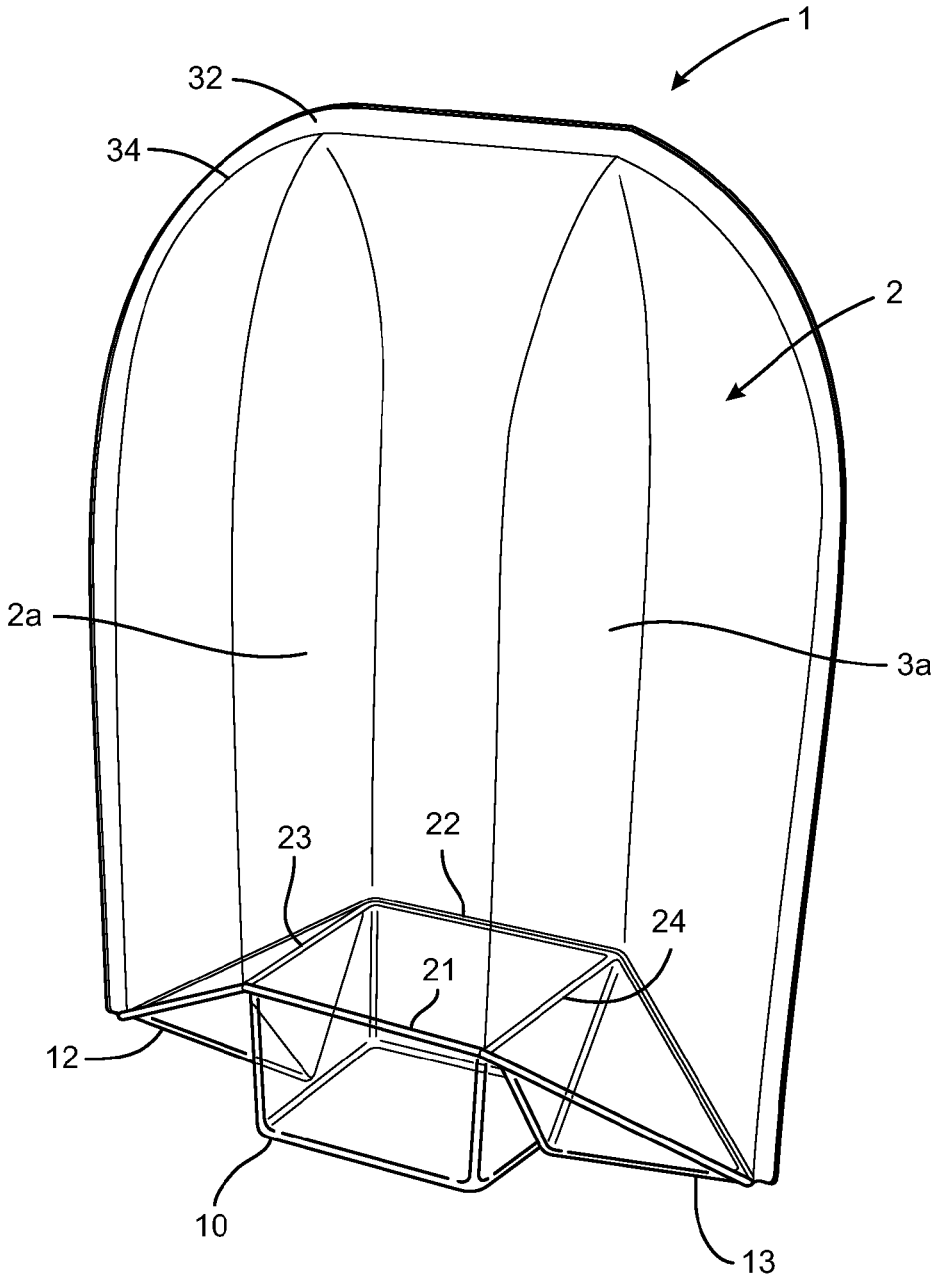
FIG. 1 is a perspective view of an exemplary clamshell packaging system constructed in accordance with the description that follows.

A clamshell packaging system 1 is described with reference to FIGS. 1-5. As shown in FIG. 1, the clamshell packaging system 1 includes first and second clamshell sides 2, 3 each having a three dimensional pocket area 2*a*, 3*a* for containing a product (not shown) when the clamshell sides 2, 3 are enclosed upon one another. Additionally, clamshell sides 2, 3 include respective peripheries 32, 33 and respective flanges 34, 35 by which the clamshell sides 2, 3 are to be mated. The embodiment also includes a base portion 10 having two downwardly extending, pyramidally shaped portions 12, 13 wherein the base portion 10 is connected to the two clamshell sides 2, 3 via a three-dimensional hinge structure. When viewed from the top, the two pyramidally shaped structures 12, 13 provide a pair of generally triangularly shaped profiles to the bottom portion. The two pyramidally shaped structures terminate with downward-pointing tips 14, 15, respectively. The base portion 10 includes joint structures or folding edges 21, 22, which connect base portion 10 to clamshell sides 2, 3 respectively. The base portion 10 further includes joint structures or folding edges 23, 24 which extend between and generally transverse to joint structures 21, 22. As seen, the joint structures 23, 24 are generally co-planarly aligned with portions 21A, 22A of the joint structures 21, 22 while portions 21B, 22B, 21C, and 22C of the joint structures 21, 22 extend downwardly towards a point where the bottom sides of the clamshell sides 2, 3 mate. The entire clamshell packaging system 1, comprising clamshell sides 2, 3, and base portion 10, is preferably formed during a molding process as a one-body piece using a thermoplastic material.

Referring again to FIG. 1 the bottom surface of base portion 10 is generally flat so as to allow the clamshell packaging case 1 to stand upright. In this embodiment, base portion 10 is rectangular or box-like in shape. When the clamshell packaging system 1 is in a closed position, the downward-pointing tips 14, 15 are parallel to the bottom surface of base portion 10. Thus when the clamshell packaging system 1 is in an upright, closed position, the tips 14, 15, together with base portion 10, provide stability. When the clamshell packaging system is in the closed position, it is held together by flanges 34, 35 which flanges may be frictionally fit together, glued together, welded together, bonded together, trapped between cardboard packaging, or the like without limitation. Further, the clamshell sides 2, 3 are able to open outwardly via the three-dimensional hinge of the clamshell packaging system 1.

Figure 2:
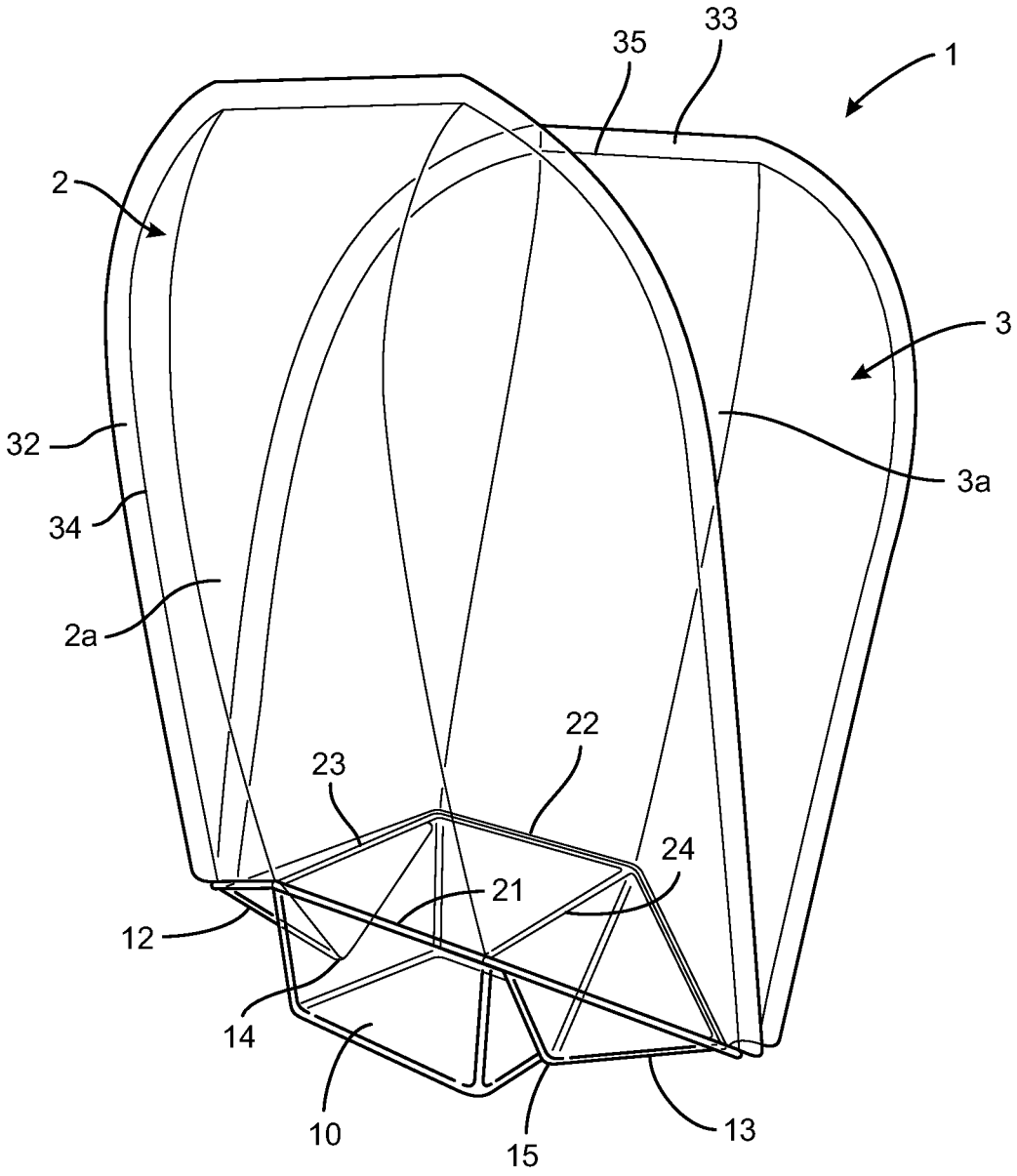
FIG. 2 is a perspective view of the clamshell packaging system illustrated in FIG. 1 in a one-quarter open position.
Figure 3:
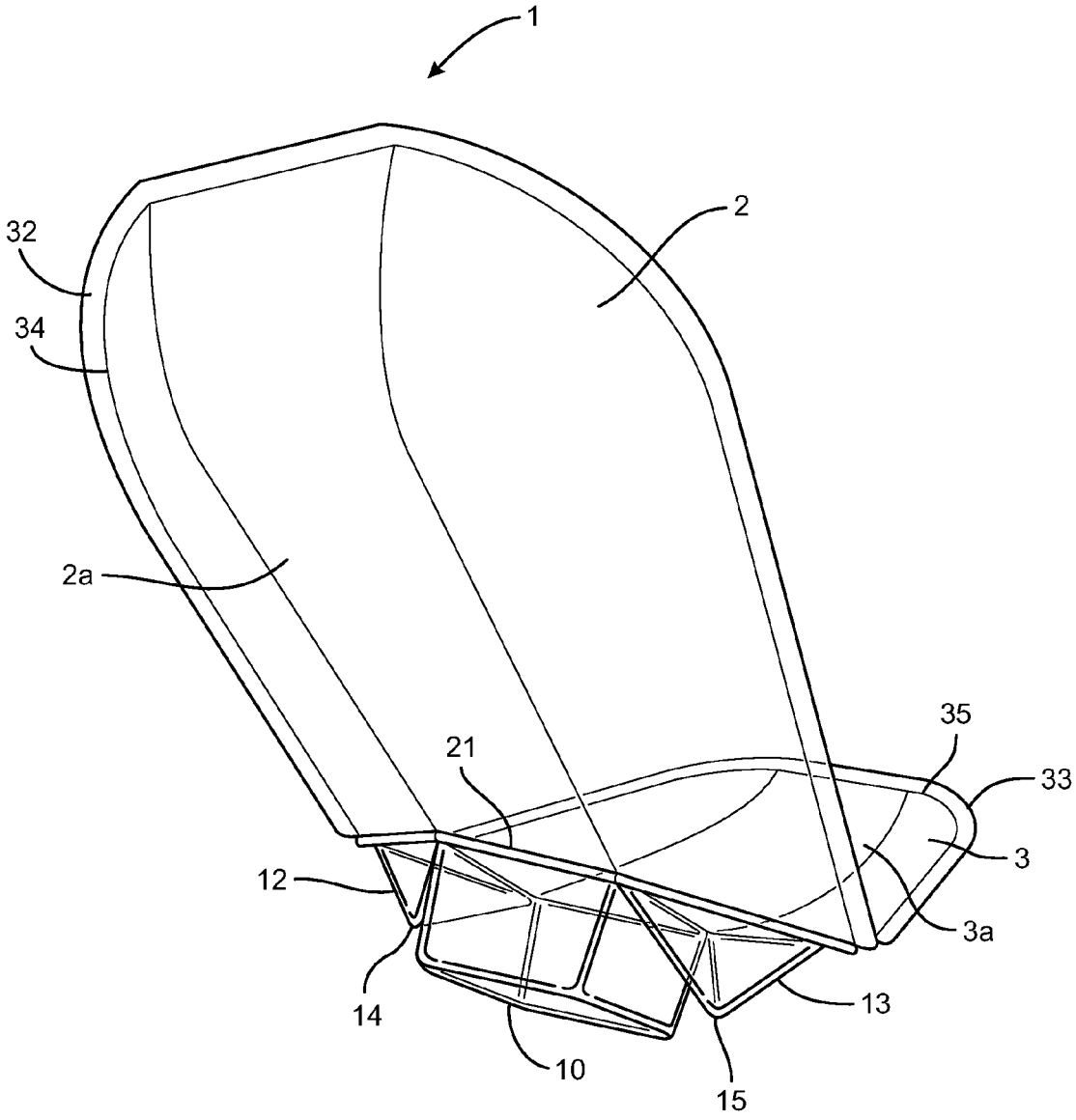
FIG. 3 is a perspective view of the clamshell packaging system illustrated in FIG. 1 in a three-quarters open position.

Referring next to FIGS. 2 and 3, the clamshell packaging system 1 opens from the edges of clamshell sides 2, 3 by folding the sides outwardly along folding edges 21 and 22, respectively. Further, as clamshell packaging system 1 opens, the base is caused to hinge at folding edges 23 and 24, respectively, causing tips 14 and 15 to generally move away from a center of the base portion 10.

Figure 4:
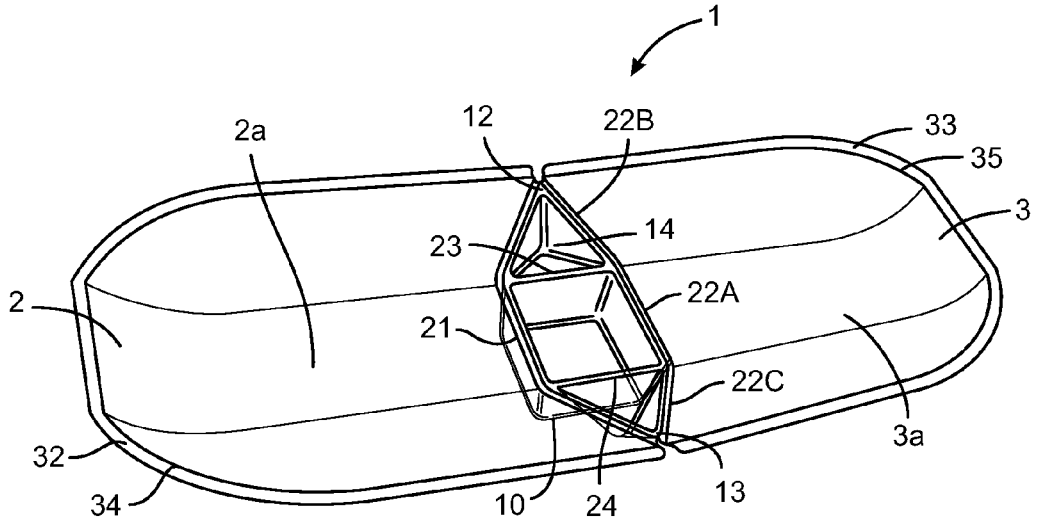
FIG. 4 is a top view of the clamshell packaging system illustrated in FIG. 1 in an open position.
Figure 5:
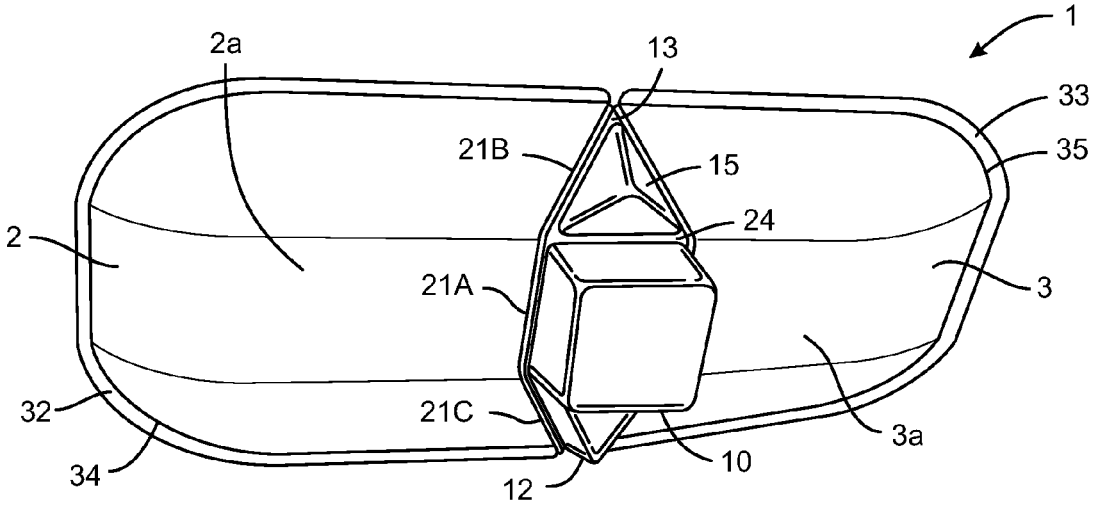
FIG. 5 is a bottom view of the clamshell packaging system illustrated in FIG. 1 in an open position.

A shown in FIGS. 4 and 5, the clamshell packaging system 1 may be opened completely so that the two clamshell sides 2 and 3 are disposed at approximately a 180° angle with respect to each other whereupon tension provided again the hinge joints may function to maintain the clamshell packaging system 1 in such a position. In this open position, base portion 10 remains facing downwards without interference from the two clamshell sides 2 and 3 so the clamshell packaging system 1 is still capable of being placed into a standing orientation.

In the preferred embodiment the two clamshell sides 2, 3 are held together by flanges 34, 35. However, in another embodiment the two clamshell sides 2, 3 may be held together by sealing clamshell peripheries 32, 33 together. In yet another embodiment, clamshell sides 2, 3 may be held together by friction fit flanges 34, 35 as well as by sealing clamshell peripheries 32, 33. In a still further embodiment, clamshell packaging system 1 may include sealed peripheries 32, 33 wherein a portion of the peripheries is perforated such that the perforated portion may be stripped off by means of a tab. Thus, after the perforated portion of clamshell peripheries 32, 33 is removed, clamshell sides 2, 3 are no longer sealed, and clamshell packaging system 1 may be opened. Additional closing and sealing configurations are known in the art and will be readily apparent to those skilled in the art.

In another embodiment, the clamshell sides 2, 3 include at least one aperture so that the clamshell packaging device 1 may hang on a hanging rod at a retail outlet.

While various concepts have been described in detail, it will be appreciated by those skilled in the art that various modifications and alternatives to those concepts could be developed in light of the overall teachings of the disclosure. For example, it will be appreciated that a variety of shapes may be used for the clamshell sides 2 and 3. As such, the particular concepts disclosed are meant to be illustrative only and not limiting as to the scope of the invention which is to be given the full breadth of the appended claims and any equivalents thereof.

What is claimed is:

1. A clamshell packaging system, comprising:

a base portion having at least one flat portion upon which the clamshell packaging system is standable;

a first side portion attached to the base portion via a first hinge joint; and a second side portion attached to the base portion via a second hinge joint wherein the second side portion is closeable upon the first side portion to provide an enclosed clamshell;

wherein the base portion further comprises a third hinge joint and a fourth hinge joint each of which extends between the first hinge joint and the second hinge joint in a direction that is generally transverse to at least a portion of each of the first hinge joint and the second hinge joint, wherein the at least one flat portion of the base portion is disposed between the third hinge joint and the fourth hinge joint, and wherein the first hinge joint, second hinge joint, third hinge joint, and fourth hinge joint form a pair of triangularly shaped profiles upon the base portion on opposite sides of the at least one flat portion.

2. The clamshell packaging system as recited in claim 1, wherein the pair of triangularly shaped profiles are non-coplanarly oriented with respect to each other.

3. The claimshell packaging system as recited in claim 2, wherein the third hinge joint and the fourth hinge joint are coplanarly oriented with respect to each other.

4. The clamshell packaging system as recited in claim 1, wherein the base portion comprises a pair of pyramidally shaped portions each of which extends downwardly between the first hinge joint, second hinge joint, and third hinge joint and the first hinge joint, second hinge joint, and fourth hinge joint, respectively.

5. The clamshell packaging system as recited in claim 4, wherein the at least one flat portion of the base portion comprises a downwardly extending block shaped portion.

6. The clamshell packaging system as recited in claim 1, wherein the first hinge joint and the second hinge joint extend non-linearly and non-coplanarly between the first side portion and the base portion and the second side portion and the base portion, respectively.

7. A clamshell packaging system comprising:

a first clamshell side, a second clamshell side, and a base portion connected via a three-dimensional hinge structure wherein a bottom surface of the base portion is generally flat such that the clamshell packaging system is standable when the first and second clamshell sides are in the closed position and when the first and second clamshell sides are in the open position, and wherein a pair of triangularly shaped profiles are formed between the first clamshell side and the second clamshell side and upon the base portion on opposite sides thereof.

8. The clamshell packaging system as recited in claim 7, wherein the base portion and the first clamshell side are connected by a first joint structure, wherein the base portion and the second clamshell side are connected by a second joint structure, and wherein the base portion has third and fourth joint structures which span the base portion between the first joint structure and the second joint structure.

9. The clamshell packaging system as recited in claim 7 wherein the first and second clamshell sides contain at least one cavity for storing at least one object.

10. The clamshell packaging system as recited in claim 9, wherein the at least one cavity is disposed along a longitudinal axis of the clamshell packaging system such that a weight of the at least one object is symmetrically balanced between the first and second clamshell sides.

11. A method for making a claim shell packing system in a mold comprised of a first side portion, a second side portion, and a base portion wherein the second side portion is closeable upon the first side portion to provide an enclosed clamshell, the method comprising:

forming a first hinge joint between the first side portion and the base portion;

forming a second hinge joint between the second side portion and the base portion;

forming a third hinge joint and a fourth hinge joint in the base portion wherein each of the third hinge joint and the fourth hinge joint extend between the first hinge joint and the second hinge joint in a direction that is generally transverse to at least a portion of each of the first hinge joint and the second hinge joint;

providing the base portion with at least one flat portion upon which the clamshell packaging system is standable;

forming at least one flat portion of the base portion between the third hinge joint and the fourth hinge joint; and forming the first hinge joint, the second hinge joint, the third hinge joint, and the fourth hinge joint into a pair of triangularly shaped profiles upon the base portion on opposite sides of the at least one flat portion.

12. The method as recited in claim 11, wherein the pair of triangularly shaped profiles are formed so as to be non-planarly oriented with respect to each other.

13. The method as recited in claim 11, wherein the third hinge joint and the fourth hinge joint are formed so as to be co-planarly oriented with respect to each other.

14. The method as recited in claim 11, wherein the base portion is formed with a pair of pyramidally shaped portions each of which will extend downwardly between the first hinge joint, second hinge joint, and third hinge joint and the first hinge joint, second hinge joint, and fourth hinge joint, respectively.

15. The method as recited in claim 14, wherein the at least one flat portion of the base portion is provided by forming the base portion with a downwardly extending block shaped portion.

16. The method as recited in claim 11, wherein the first hinge joint and the second hinge joint are formed so as to extend non-linearly and non-coplanarly between the first side portion and the base portion and the second side portion and the base portion, respectively.

* * * * *